United States Patent [19]

Vanmunster

[11] 3,941,674

[45] Mar. 2, 1976

[54] PLATING RACK

[75] Inventor: Richard H. Vanmunster, Attenhoven, Belgium

[73] Assignee: Monroe Belgium N.V., Sint-Truiden, Belgium

[22] Filed: May 31, 1974

[21] Appl. No.: 474,902

[52] U.S. Cl. ..... 204/212; 204/286; 204/297 W

[51] Int. Cl.[2] ..... C25D 17/08; C25D 17/28

[58] Field of Search ..... 204/212, 286, 280, 288, 204/215, 218, 297 R, 297 W

[56] References Cited

UNITED STATES PATENTS

| | | | |
|---|---|---|---|
| 1,838,187 | 12/1931 | Moon | 204/212 |
| 2,879,209 | 3/1959 | Fialkoff | 204/212 X |
| 3,455,810 | 7/1969 | Holm | 204/286 |
| 3,664,944 | 5/1972 | Buckley | 204/212 |
| 3,772,178 | 11/1973 | Wilson | 204/286 X |

*Primary Examiner*—F. C. Edmundson

*Attorney, Agent, or Firm*—Harness, Dickey & Pierce

[57] ABSTRACT

A plating rack for use in plating a plurality of cylindrically shaped articles such as piston rods. The articles are supported in vertical orientation between upper and lower frame structures. A plurality of individual drive assemblies each having a threaded socket are rotatably supported on the upper frame structure, and a plurality of tubular protection sleeves are supported on the lower frame structure. The upper end of each article is threaded for connection with the drive socket of one of the drive assemblies, and the lower end of each article fits within one of the protection sleeves. The drive sockets rotate in unison, and plating current is supplied to each article through its associated drive assembly via brushes which are biased against the drive assembly. The protection sleeves on the lower frame structure are hingedly mounted thereon to facilitate loading and unloading of the articles into and from the rack. The lower frame structure can be positioned with respect to the upper frame structure thereby rendering the rack suitable for articles of different lengths.

19 Claims, 10 Drawing Figures

PLATING RACK

BACKGROUND AND SUMMARY OF THE INVENTION

The present invention pertains generally to plating apparatus and, in particular, to a novel plating rack with which a plurality of cylindrically shaped articles may be simultaneously plated.

In conventional plating practice, such as in chrome plating, etc., it is usually desired to obtain a substantially uniform thickness in the layer of plating deposited on the article or articles being plated. This is especially important where cylindrical piston rods having a circular cross section are to be plated, since variations in the thickness of the chrome plating layer can result in departure from a true circular shape. Where such piston rods are plated on a mass production basis, the techniques of the prior art leave much to be desired in attaining an accurate yet efficient process. Heretofore, groups of piston rods have been simultaneously plated in a plating bath with the aid of plating racks in which the articles are fixedly set. By way of example, these racks may include a contact beam, or contact bar, having a plurality of threaded holes at locations along the length of the rod into which threaded ends of the piston rods are threaded. The beam is usually oriented either horizontally or vertically on the rack with the piston rods being correspondingly oriented either vertically or horizontally. The rack is placed in the plating bath between a pair of anodes which are electrically coupled with the anode terminal of a source of plating current. The piston rods are electrically connected via the contact beam to the cathode terminal of the plating current source. Where the free ends of the piston rods are intended not to be plated, a protection screen is provided on the rack to screen these ends from the anodes. With this technique, the plating layer is of irregular thickness, typically oval. A further problem is that the number of piston rods which can be plated at one time is limited because each piston rod must face both anodes. In some racks, a row of piston rods is placed above another row of piston rods, and this has the disadvantage of exposing the piston rods in the upper row to gas generated by those in the lower row during plating which can adversely affect the plating of the articles in the upper row. Also, loading and unloading of the piston rods into and out of the rack is tedious. Although it is known in the art to rotatably support a single cylindrically shaped article in a plating tank during plating, as evidenced by U.S. Pat. No. 3,664,944, such a technique is hardly suitable for mass production plating of cyindrical articles.

Accordingly, the present invention is directed to a novel plating rack which enables a plurality of cylindrically shaped articles to be simultaneously plated with greater uniformity in the resulting plating thickness and with improved efficiency. Pursuant to principles of the present invention, the articles to be plated are rotatably supported in the rack for rotation about their longitudinal axes. With the rack immersed in a plating tank, the articles rotate in unison as plating current flows from each article to an anode which faces the rack. The features of the present invention include: improved facility in loading and unloading the rack; improved efficiency in supplying the plating current to the articles in the rack; and adaptability for articles of different lengths. These features are attained through novel plating rack structure including: novel gear and drive socket assemblies via which the articles are rotated and via which plating current is conducted to the articles; hingedly mounted protection sleeves for protecting the ends of the articles to prevent plating thereof; vertical adjusters at the sides of the rack for vertically adjusting upper and lower rack structure with respect to each other; an improved rack structure via which plating current is conducted from the cathode of the plating current supply to the articles mounted in the rack.

The foregoing features, along with additional features and advantages of the invention, will be seen in the ensuing description and claims which are to be taken in conjunction with the accompanying drawings.

BRIEF DESCRIPTION OF THE DRAWINGS

FIG. 6 is an enlarged view partly in section of the lower portion of FIG. 3.

FIG. 7 is an enlarged view partly in section of the upper portion of FIG. 3.

DESCRIPTION OF THE PREFERRED EMBODIMENT

Figures 1, 2:
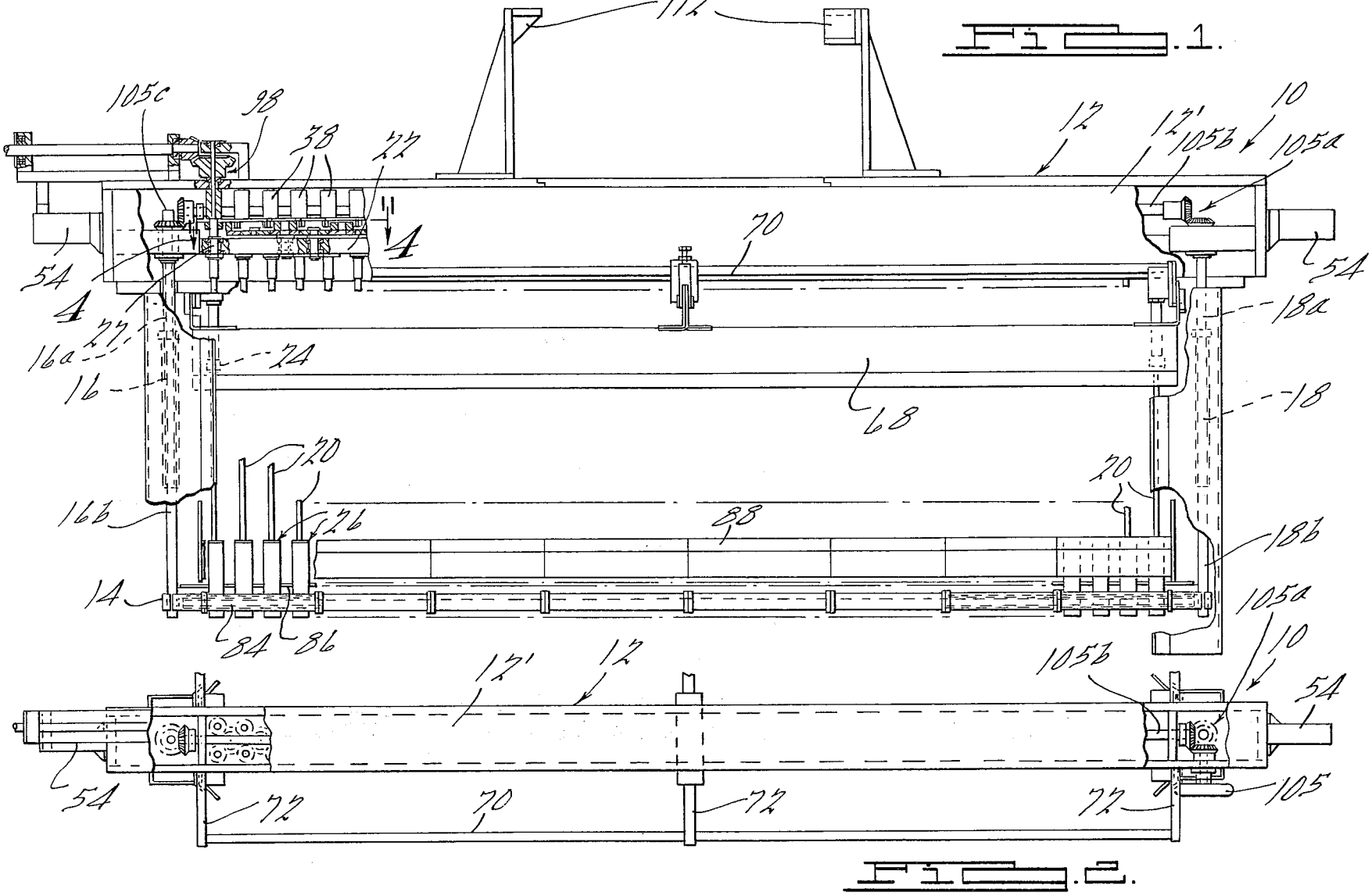
FIG. 1 is a front view of a plating rack embodying principles of the present invention and having portions broken away.
FIG. 2 is a top view of FIG. 1 having portions broken away.
Figures 1, 3, 5:
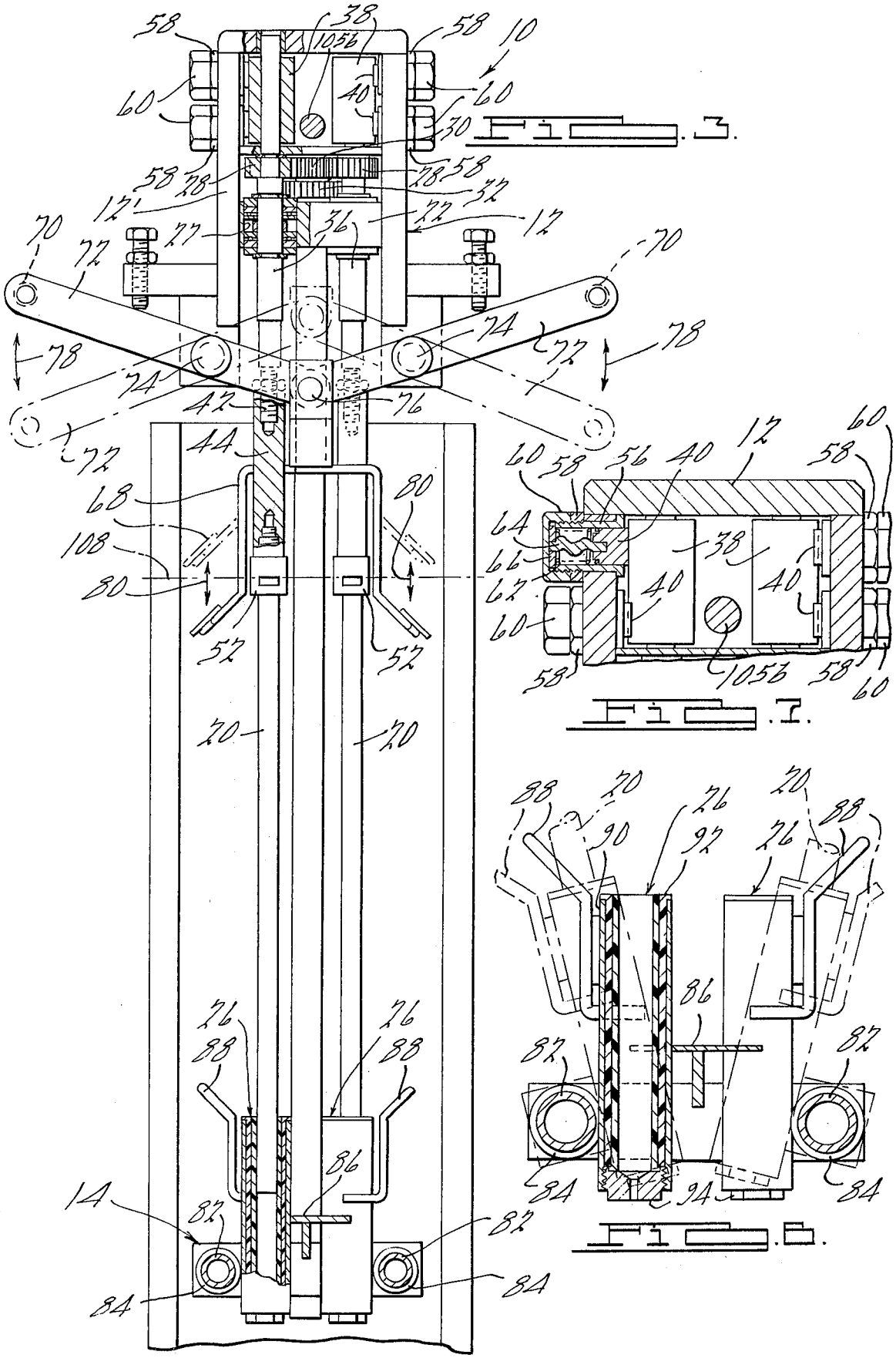
FIG. 3 is an enlarged right-hand view of FIG. 1 having portions broken away.
FIG. 5 is a vertical sectional view taken in the direction of arrows 5—5 in FIG. 4.
Figure 5:
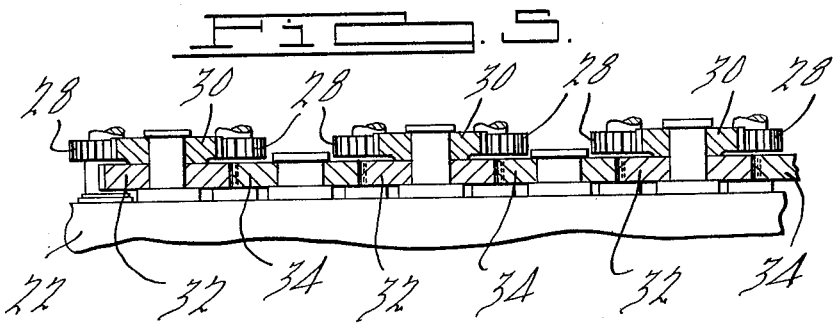

In FIGS. 1, 2, and 3, a generally rectangular plating rack 10 embodying principles of the present invention comprises parallel upper and lower frame structures 12 and 14 respectively and adjusters 16 and 18 connecting opposite ends of the upper and lower frame structures. A plurality of cylindrically shaped articles 20, hereinafter illustratively described as piston rods 20, are mounted vertically on rack 10 and extend between the upper and lower frame structures. Upper frame structure 12 includes an enclosed rectangular casing 12' having a top, two sides, and two ends but open at the bottom. A horizontal mounting plate 22 (FIG. 1) is contained within casing 12' and serves to mount a plurality of individual drive assemblies 24, each of which drivingly connects with a piston rod 20. A plurality of protection sleeves 26 mount on lower frame structure 14 with each sleeve 26 being vertically aligned with a corresponding drive assembly 24. Drive assemblies 24 are arranged in two horizontally extending parallel rows, as are the sockets 26, whereby piston rods 20, when mounted in the rack, form two parallel horizontally extending rows in which the axes of piston rods 20 are vertically oriented. Each drive assembly 24 is journaled for rotation via bearings in a vertical bore 27 in mounting plate 22.

Figure 4:
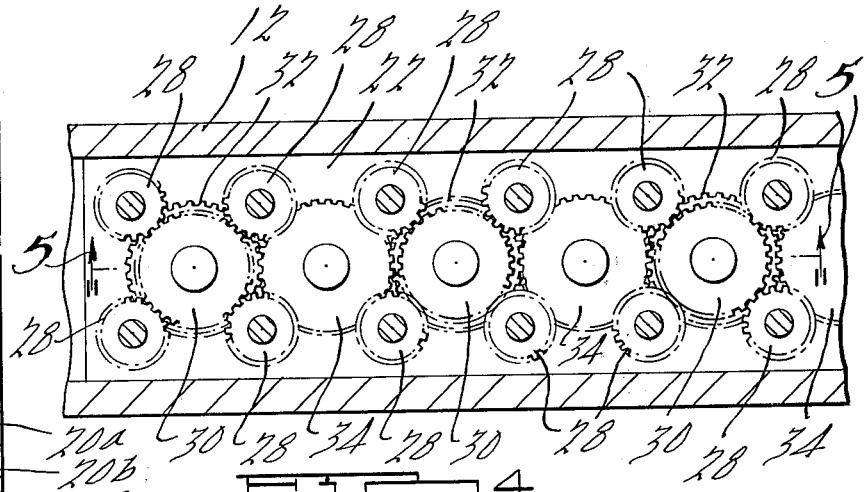
FIG. 4 is an enlarged fragmentary horizontal sectional view taken in the direction of arrows 4—4 in FIG. 1.

Drive assemblies 24 rotate in unison and are powered from a drive mechanism which includes a gear train operatively coupling the drive assemblies (see FIGS. 4 and 5 also). A driven pinion 28 is affixed to each drive assembly 24 above mounting plate 22. A plurality of pairs of pinions 30 and 32 are rotatably supported on mounting plate 22 to rotate together. Each pinion pair 30, 32 is located at the center of a set of four driven pinions 28 with each pinion 30 meshing with the four driven pinions 28 in the set. Thus, the pinions 30 and 32, along with the four pinions 28 in the set, rotate in unison. Pinions 32 are operatively coupled together via idler pinions 34 rotatably supported on mounting plate 22 between adjacent pinions 32. In this way, each successive set is driven by the immediately preceding set. As will be explained in greater detail later, power input to the gear train assembly is via the pinion 28 at the upper left-hand corner of FIG. 4. With this arrangement, therefore, rotation of that pinion 28 rotates the remaining three pinions 28 in the first set and the pinions 30 and 32 in the first set. The first idler pinion 34 couples the rotation of the first set to the second set, and so on down the line. In this way, all drive assemblies 24 rotate in unison.

Figure 8:
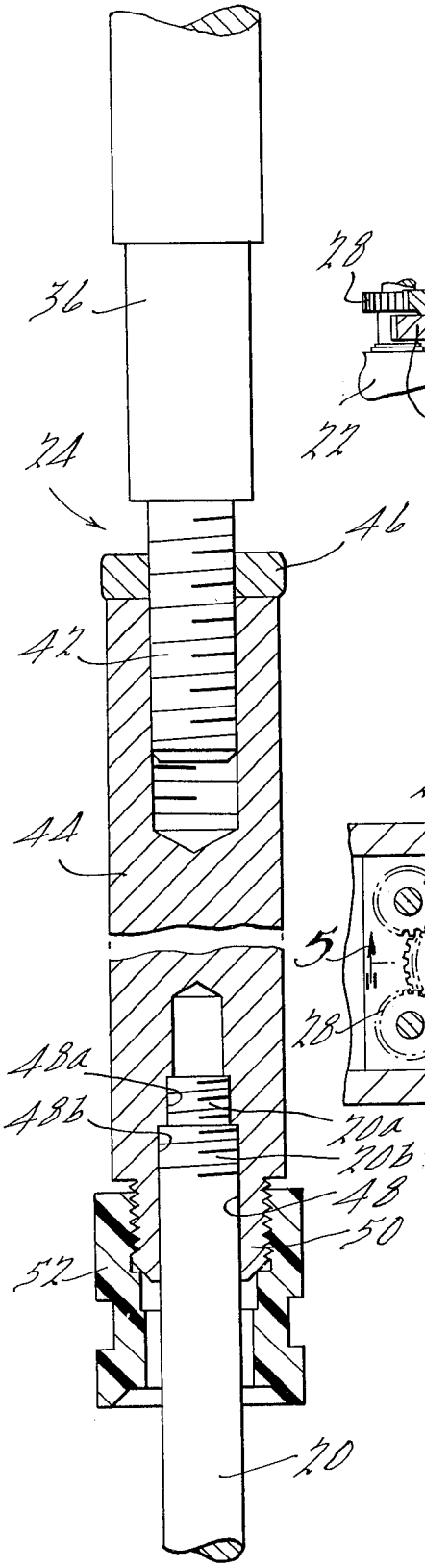
FIG. 8 is an enlarged longitudinal sectional view through one of the drive socket assemblies mounted on the rack.

Further details of drive assemblies 24 can be seen in FIGS. 3 and 8. Each drive assembly 24 comprises a vertical drive shaft 36 journaled by the bearings in its bore 27 for rotation on mounting plate 22. The upper end of each drive shaft 36 includes a circular cylindrical bushing 38 (FIGS. 3 and 7) against which a pair of conductive brushes 40 on casing 12′ are biased into engagement to supply plating current to the drive assembly and piston rod, as will be explained in greater detail later. The lower end of drive shaft 36 terminates in a threaded tip 42 onto which a drive socket 44 is threaded. Each socket 44 is locked in place on tip 42 by a jam nut 46. As best seen in FIG. 8, the lower end of each socket 44 is provided with a bore 48 into which the threaded upper end of piston rod 20 is threaded. In accordance with one feature of the present invention, bore 48 is provided with sections **48*a*, 48*b* of different thread. Section 48*a* is provided with a screw thread of a certain size while the counter-bore section 48*b* is provided with a screw thread of a different size. The upper end of piston rod 20 is provided with mating screw threads 20*a* and 20*b* respectively which threadedly engage screw threads 48*a*, 48*b* respectively. This mechanical connection for mounting the piston rods, while being mechanically expeditious, also affords improved electrical conductivity between each drive assembly and piston rod thereby promoting efficiency in conducting plating current to the rods. A projecting tip 50 on the lower end of socket 44 is threaded to receive a short tubular protection sleeve 52 which may be used to shield the upper end segment of piston rod 20.**

Cathode blocks 54 (FIG. 1) are provided at the ends of casing 12′ for connection to the cathode terminal of a conventional source of plating current (not shown). Plating current is conducted from the source through casing 12′ to the brushes 40. Brushes in turn carry the current to drive assemblies 24 and, hence, to the rods 20, two brushes per drive assembly. As best shown in FIG. 7, each brush 40 is disposed within a bushing 56 mounted in a corresponding hole in one of the sides of casing 12′. Each bushing 56 is securely retained by means of a lip on the inner end of the bushing and a lock nut 58 which is threaded onto the threaded end of the bushing which protrudes through to the outside of the casing. A threaded cap 60 is threaded onto the exterior end of bushing 56, and each brush 40 is biased against the drive assembly bushing 38 by means of a helical coil spring 62 disposed between the brush and the cap 60. A conductor wire 64 has one end thereof making contact with the brush 40, and the other end thereof making contact with a plate 66 which is held between the end cap 60 and the outer end of bushing 56 thereby providing suitable electrical connection from casing 12′ to the brush. As drive assemblies 24 are rotated by the gear train, plating current is conducted via brushes 40 to drive assemblies 24 and, hence, to the rods threaded into the drive assemblies.

Also supported on upper frame structure 12 is an upper protection screen 68 which is guided on sockets 44 for vertical movement between a lower position shown in the solid lines in FIG. 3 and an upper position shown in broken lines. Upper protection screen 68 is manually operated by means of handles 70 which extend generally parallel to the upper frame structure 12 on opposite sides thereof. Handles 70 are connected with upper protection screen 68 by means of levers 72 which are pivotally mounted on the rack as at 74 and which connect with tabs on the protection screen 68 as indicated at 76. As either one of the handles 70 is operated in the manner indicated by arrows 78, upper protection screen 68 is displaced as indicated by the arrows 80. Normally, screen 68 assumes the lower position when shielding the drive assemblies during plating and the upper position when the rack is removed from the plating bath to provide convenient access for loading and unloading of rods.

Details of lower frame structure 14 and protection sleeves 26 are best shown in FIGS. 1 and 6. The ends of the lower frame structure are fixedly secured to the lower ends of the side assemblies 16 and 18. The lower frame structure 14 includes a pair of horizontal tubes 82 which extend the full length of the rack. Sleeves 26 are arranged in groups of a predetermined number (for example, four sleeves as shown at the lower left-hand corner of FIG. 1) affixed at right angles to a tubular sleeve 84. Sleeves 84 are journaled on tubes 82. A plate 86 is centrally supported on the lower frame structure to assist in supporting the sleeves 26 in the vertical position indicated in solid lines in FIG. 6. The construction provided by journaling sleeves 84 on tubes 82 permits sleeves 26 to be swung outwardly about tubes 82 from the vertical position to an inclined position indicated in broken lines in FIG. 6. This facilitates loading and unloading of articles into and out of the rack. Protection screens 88 mount to protection sleeves 26 to screen the lower end sections of the piston rods from the anodes. The protection sleeves themselves comprise an exterior tube 90, an interior liner 92, and cap 94 is threaded into the bottom of each tube 90.

Figure 9:
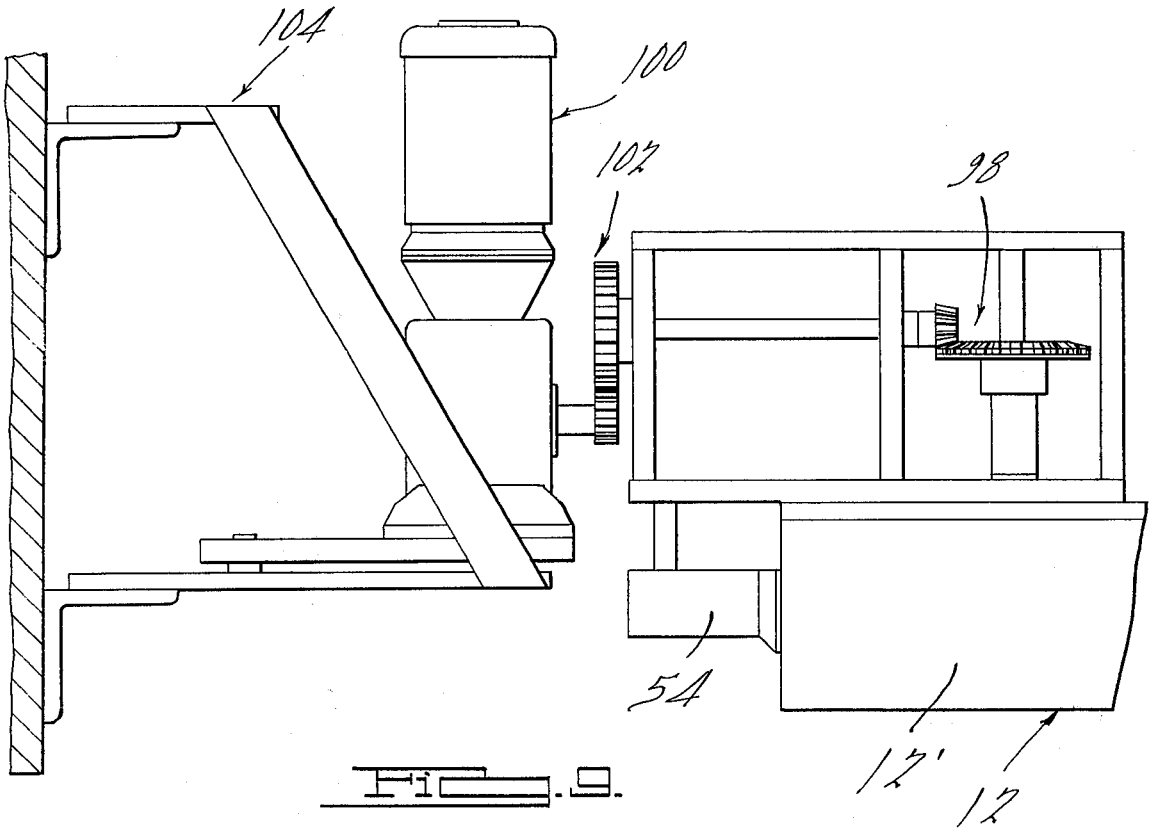
FIG. 9 is a view showing a power mechanism for rotating the drive socket assemblies.

Details of the power source for rotating the drive assemblies are shown in FIG. 9. A gear set 98 mounts on casing 12′ (at the upper left-hand corner thereof as viewed in FIG. 1) to rotate the first drive assembly 24 as mentioned earlier. The gear set 98 is powered from a conventional electric motor 100 via gear reduction 102. It should be noted that the motor 100 need not be mounted on the rack itself and could be mounted on suitable support structure adjacent the rack as indicated at 104.

A further feature of rack 10 resides in vertical adjusters 16 and 18 along with the associated adjustment mechanism. Adjusters 16 and 18 permit upper and lower frame structures 12 and 14 to be vertically positioned with respect to each other to accommodate rods of varying lengths. The vertical adjusters 16 and 18 include threadedly engaged elements 16*a*, 16*b*, and 18*a*, 18*b* respectively. Simultaneous adjustment of elements 16*a* and 18*a* with respect to elements 16*b* and 18*b* respectively is accomplished by rotating hand wheel 105 (FIG. 2) on the upper frame structure. The hand wheel operates a beveled gear set 105*a*, element 18*a* being operated directly from the gear set 105*a* while element 16*a* is operated via shaft 105*b* and a second gear set 105*c*. With this arrangement, as hand wheel 105 is turned in one direction, the adjusters 16 and 18 extend to increasingly separate the upper and lower frame structure; operation of the hand wheel in the other direction retracts the adjusters thereby decreasing the separation between the upper and lower frame structures.

Figure 10:
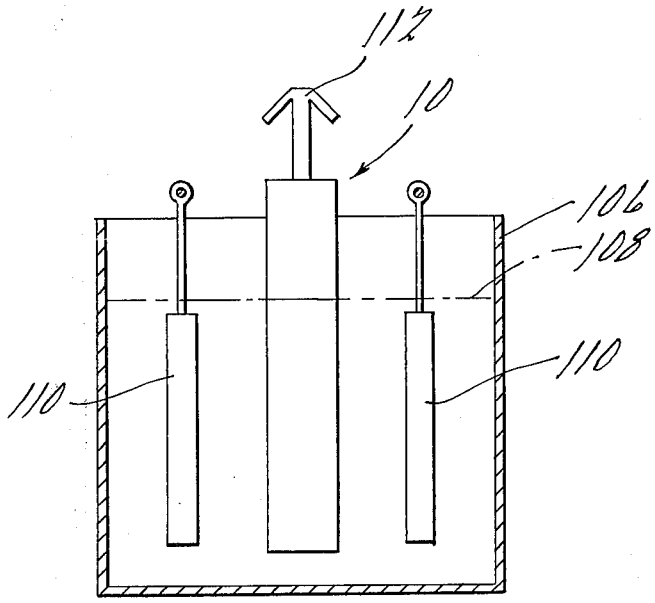
FIG. 10 is a semi-schematic view illustrating the plating rack in use.

FIG. 10 shows plating rack 10 in use in a plating tank 106 containing plating solution to a level 108 and a pair of anodes 110 which connect to the anode terminal of the source of plating current. Plating rack 10 is disposed between the pair of anodes so that each row of rods in the rack faces one of the anodes 110. Note that only one anode is required per row of rods. As the piston rods rotate within the rack, plating current is supplied to the rods.

In light of the foregoing description of the preferred embodiment of plating rack 10, the manner in which the plating rack may be used can now be explained. Piston rods 20 which are to be plated may be expeditiously loaded into the rack by hand. Each piston rod is loaded by first inserting the lower end thereof into one of the lower protection sleeves 26. Where the length of the piston rod is greater than the vertical clearance between the bottom of each drive assembly sleeve 52 and the top of each protection sleeve 26, protection sleeve 26 are pivoted outwardly away from the vertical position to permit the piston rods to be inserted therein. Each pivotally mounted set of protection sleeves 26 is loaded with its complement of piston rods with the protection sleeves 26 being sufficiently deep that the upper end of each piston rod can clear the corresponding drive assembly sleeve 52 as the set of protection sleeves is pivoted back toward the vertical position preparatory to connecting the piston rods with the drive assemblies 24. Upper protection screens 68 can be raised by operating one of the handles 70 to provide clearance for the upper end of the piston rods as they are swung to the vertical position. Each piston rod 20 is now raised vertically and threaded into the corresponding drive socket 44. The connection of each piston rod to its drive socket is most expeditiously accomplished by operating motor 100 in a direction which will cause threads 20*a* and 20*b* to be threaded into bores 48*a* and 48*b* respectively as each piston rod is inserted into its drive socket. Conveniently, the piston rods may be grasped with a pliers which permits the loading operation to be done without damaging the surface portion of the piston rod which is to be plated. The entire rack may be loaded with a full complement of the piston rods in this manner.

Once the rack has been loaded, it is ready to be placed in the plating bath as indicated in FIG. 10. The rack may be supported by means of brackets 112 on suitable supporting structure (not shown). Cathode blocks 54 on the rack are electrically connected with the cathode of a source of plating current (not shown). The anodes 110 are connected to the anode of the plating current source. The plating source and the connections of the rack and anodes thereto can be accomplished in any conventional manner. With the plating rack in the bath, motor 100 is operated to rotate the drive socket assemblies and, hence, to rotate all piston rods in unison. The plating current is conducted from the cathode blocks 54 through casing 12′ to all the brushes 40 which are supported thereon. The brushes in turn carry the current to each bushing 38 of each drive assembly 24 and through the drive assembly to the piston rod connected therewith. With this construction of the rack, an efficient conductive path is provided in the rack via which plating current is conducted to each article. As the piston rods rotate in the rack, a substantially uniform layer of plating is deposited on each piston rod. The protection screens and the sockets serve to shield the end segments of the pistons rods from plating current so that only the intermediate surface portion of each rod is plated. It will be also noted that with the present invention the number of rods which can be plated in a given setup is increased since it is unnecessary that each row of rods face both anodes. In other words, only one anode is required per row of rods. It will also be noted that the contact between the rack and each piston rod is disposed at a level above the plating solution. Consequently, electrochemical wear is avoided, and preventive maintenance and inspection can be more easily accomplished. In the event that the contact between any socket 44 and piston rod becomes poor, this condition can be observed by the operator when the parts are unloaded. A defective or worn socket is simply replaced by unthreading it from the drive shaft and installing a new drive socket. It will be appreciated that suitable insulating and shielding material can be provided on the rack to insulate the parts thereof from contact with the plating current path through the rack. Well-known insulating material can be used and can be applied between the parts which are to be insulated from the other parts which form the current-carrying path through the rack. The particular details of the plating operation, such as current density, duration, temperature, bath composition, etc., can be selected with known techniques to provide the desired plating layer. With the present invention, it is possible to provide an extremely accurate plating thickness (for example, a tolerance of three microns) without the need for any subsequent operation such as regrinding and/or buffing. Furthermore, selected portions of the articles can be plated with other portions thereof remaining unplated.

After plating, piston rods 20 may be unloaded from the rack in the opposite manner in which they are loaded. The piston rods may be grasped with a pliers, and the drive sockets rotated in a direction which will cause the piston rods to unthread from the drive sockets. The piston rods drop into the protection sleeves to clear the drive assemblies, and screen 68 may be elevated to permit the piston rods and protection sleeves to be swung outwardly whereby the rods may be removed from the sleeves.

Thus, it can be seen that the present invention provides a novel plating rack which greatly facilitates loading and unloading of articles and yet which provides an improved plating technique for attaining a more uniform plating thickness for cylindrically shaped objects. Although the particular articles with the use of the rack has been illustratively described herein are of circular, cylindrical shape, it will be appreciated that the inventive principles embodied in the rack are not limited by the particular shape of the articles with which it is used.

While it will be apparent that the preferred embodiment of the invention disclosed is well calculated to fulfill the objects above stated, it will be appreciated that the invention is susceptible to modification, variation, and change without departing from the spirit thereof.

I claim:

1. A plating rack for use in plating cylindrically contoured surfaces of articles having threaded end portions, said plating rack comprising: a frame comprising generally parallel, vertically spaced upper and lower frame structures; support means on said frame structures, said support means including vertically oriented drive assemblies for supporting said articles on said frame such that said articles are rotatable about parallel vertical axes defined by the cylindrically contoured surface thereof; drive means for simultaneously rotating said articles in the same direction about their respective axes; and conductor means including means for conducting plating current through each of said drive assemblies to the article connected thereto.

2. A plating rack as claimed in claim 1 wherein said support means is arranged to support said articles in two rows on opposite sides of said frame.

3. A plating rack as claimed in claim 1 wherein each of said drive assemblies includes a screw thread means thereon for effecting connection to the threaded end portions of the articles being plated.

4. A plating rack as claimed in claim 3 wherein said screw thread means comprises a pair of differently sized screw threads.

5. A plating rack as claimed in claim 4 wherein said screw thread means is fashioned as an internal screw thread on each drive assembly.

6. A plating rack as claimed in claim 5 wherein one screw thread is fashioned in a bore in said drive assembly and the other screw thread is fashioned in an adjacent counter-bore.

7. A plating rack as claimed in claim 1 including protection screening means for protectively screening a limited portion of the surface of each article during plating, said protection screening means being mounted for movement between different positions.

8. A plating rack as claimed in claim 7 wherein said protection screening means is arranged for movement with respect to said support means.

9. A plating rack as claimed in claim 8 wherein said drive means includes a plurality of drive assemblies, each of which is arranged to connect to each article, said protection screening means being mounted for displacement lengthwise of said drive assemblies.

10. A plating rack as claimed in claim 1 wherein said frame is of generally rectangular shape and arranged such that said articles are supported between one pair of opposite sides of said frame and including positioning means at the other pair of opposite sides of said frame for positioning the sides of said first pair with respect to each other.

11. A plating rack as claimed in claim 23 including manual adjustment means for adjusting said positioning means to thereby position the sides of said first pair with respect to each other.

12. A plating rack as claimed in claim 1 wherein said conductor means is arranged to supply plating current to each article through a path including the drive assembly to which the article connects.

13. A plating rack as claimed in claim 12 wherein each said drive assembly includes a cylindrical portion and said conductor means includes brush means biased against said cylindrical portion.

14. A plating rack as claimed in claim 1 wherein each said drive assembly includes a screw thread via which the article connects to the drive assembly.

15. A plating rack as claimed in claim 14 wherein said screw thread is an internal screw thread provided on said drive assembly.

16. A plating rack as claimed in claim 1 further including a plurality of protection sleeves on the other of said frame structures, each of said protection sleeves being in alignment with a corresponding drive assembly, each article having one end connected with a drive assembly and its opposite end disposed within the corresponding protection sleeve.

17. A plating rack as claimed in claim 16 wherein said protection sleeves are hingedly mounted on said other frame structure.

18. A plating rack as claimed in claim 16 wherein the vertical clearance between each drive assembly and a corresponding protection sleeve is less than the overall length of the article mounted thereon.

19. A plating rack as claimed in claim 16 including protection screen means mounted on said protection sleeves.

* * * * *

UNITED STATES PATENT AND TRADEMARK OFFICE

CERTIFICATE OF CORRECTION

PATENT NO. : 3,941,674

DATED : March 2, 1976

INVENTOR(S) : Richard H. Vanmunster

It is certified that error appears in the above-identified patent and that said Letters Patent are hereby corrected as shown below:

Col. 3, lines 46 and 47, "threadedly" should be --threadably--;

Col. 8, line 16, "claim 23''should be --claim 10--.

Signed and Sealed this

*eighth* Day of *June 1976*

[SEAL]

*Attest:*

RUTH C. MASON
*Attesting Officer*

C. MARSHALL DANN
*Commissioner of Patents and Trademarks*